United States Patent [19]

Yanagishima et al.

[11] Patent Number: 4,502,122

[45] Date of Patent: Feb. 26, 1985

[54] METHOD AND APPARATUS FOR MEASURING VEHICLE DRIVER'S FATIGUE TO GIVE AN ALARM

[75] Inventors: Takayuki Yanagishima, Yokosuka; Yasutoshi Seko, Yokohama, both of Japan

[73] Assignee: Nissan Motor Company, Limited, Japan

[21] Appl. No.: 384,031

[22] Filed: Jun. 1, 1982

[30] Foreign Application Priority Data

Jun. 3, 1981 [JP] Japan ..... 56-84425

[51] Int. Cl.[3] ..... G08B 21/00

[52] U.S. Cl. ..... 364/424; 340/575; 180/272

[58] Field of Search ..... 364/424, 569; 340/575, 340/576; 180/271, 272

[56] References Cited

U.S. PATENT DOCUMENTS 3,877,541 4/1975 Takeuchi et al. ..... 180/272
4,005,398 1/1977 Inoue et al. ..... 180/272
4,017,843 4/1977 Yanagishima ..... 180/272
4,058,796 11/1977 Oishi et al. ..... 340/575
4,234,051 11/1980 Morris, Jr. ..... 180/272

FOREIGN PATENT DOCUMENTS 48-15104 5/1973 Japan .
48156878 12/1976 Japan .
52-13232 2/1977 Japan .

*Primary Examiner*—Gary Chin
*Attorney, Agent, or Firm*—Lowe, King, Price & Becker

[57] ABSTRACT

An alarm device is adapted to detect accumulation of fatigue of an automotive vehicle driver and to set an alarm time clock to produce an alarm. The detection of accumulation of fatigue is based on selected driving conditions of the vehicle and the period of time during which the detected driving condition is maintained. Fatigue data obtained based on the driving condition and the time is accumulated to determine a correction or updated value of the set time to be compared with the actual driving time. An alarm device will be activated when the driving time reaches the updated time.

26 Claims, 12 Drawing Figures

METHOD AND APPARATUS FOR MEASURING VEHICLE DRIVER'S FATIGUE TO GIVE AN ALARM

BACKGROUND OF THE INVENTION

The present invention relates generally to a method and device for detecting vehicle driver fatigue in driving and for generating an alarm for the driver to rest. More particularly, the invention relates to a method and device for measuring a period of driving time in which the driver becomes fatigued and for giving an alarm to the driver to indicate that it is time to take a rest.

It has been well known that it is recommendable to take a rest every two or two and a half hours driving for refreshing oneself and for recovering from driving fatigue. It is especially necessary for the driver to take a rest in driving a relatively long time.

There have been developed and proposed various alarm devices for generating an alarm for resting. For example, published Japanese Utility Model (Tokko Sho) No. 48-15104 shows an alarm device which is associated with a tachograph to produce an alarm at a given time. On the other hand, unexamined Japanese Utility Model Publication (Jikkai Sho) No. 51-156878 shows a device for displaying a required resting period of time depending on a driving period.

Since the foregoing devices are adapted to provide the alarm for the vehicle at certain fixed timing intervals, the timing to generate the alarm does not always correspond to the driver's fatigue. For example, if the driver takes a rest before the fixed time therefor or if a driving condition is significantly varied, the fixed timing for providing the alarm will not correspond to the driver's fatigue.

To improve the above-mentioned defect, unexamined Japanese Utility Model (Tokkai Sho) No. 52-13232 shows another alarm device which counts a clock signal to detect the timing to give the alarm. In this device, the timing is detected by analog processing of the clock signal. Therefore, if the driving time is relatively long, e.g., 3 hours, the analog processing of the clock signal must be continued for a long time and requires a substantially large capacity of an analog arithmetical element. Further, by accumulation of error in measurement, the accuracy of detecting the timing by calculation will be lowered.

SUMMARY OF THE INVENTION

Therefore, it is an object of the present invention to provide a method for effectively and accurately detecting the driver's fatigue and giving a suggestive alarm for the driver to take a rest at a suitable time.

Another object of the present invention is to provide a device for detecting driving time to generate an alarm taking various driving conditions into account and to produce the alarm based also on the detected driving time.

The invention is directed toward an alarm device which is adapted to detect the accumulation of fatigue of an automotive vehicle driver and to preset a time for producing the alarm. The detection of accumulation of fatigue will be made based on a driving condition of the vehicle and on the period of time during which the detected driving condition is maintained. Fatigue data obtained based on the driving condition and the time is accumulated to determine a correction value of the preset time for comparison with a driving time. An alarm device is activated when the driving time reaches the preset time.

The invention is also directed to a method for giving a suggestive alarm for a fatigued driver of an automotive vehicle. The method essentially comprises the steps of detecting the variation of a driving condition of the vehicle, measuring the accumulation of fatigue of the driver, updating said measured fatigue data whenever the driving condition is varied, correcting a preset alarm time based on said accumulated fatigue data whenever said variation of the driving condition is detected; and producing an alarm when the driving period reaches said corrected preset time. In this manner, the driver may be alerted that he is becoming drowsy or fatigued and take a rest from further driving.

The invention may also be characterized as a device for giving a suggestive alarm for a fatigued driver of an automotive vehicle, comprising, first means for sequentially measuring driving time, second means for presetting a period for producing an alarm, said second means comparing said measured time with said preset period to produce the alarm when said measured period reaches said preset time, third means for detecting a variation of a driving condition of the vehicle and producing a signal indicative of the driving condition being detected, fourth means for processing said signal with time data measured by said first means to obtain fatigue data descriptive of the driver, which fourth means includes a memory for storing the obtained fatigue data which is updated whenever there occurs a variation of the driving condition, and fifth means for correcting said preset time of said second means based on the fatigue data in said fourth means whenever variation of the driving condition occurs.

BRIEF DESCRIPTION OF THE DRAWINGS

The present invention will be understood more fully from the detailed description given herebelow and from the accompanying drawings of the preferred embodiments of the invention, which, however, should not be taken as limitative of the invention but for elucidation and explanation only.

In the drawings.

DESCRIPTION OF THE PREFERRED EMBODIMENT

Figure 1:
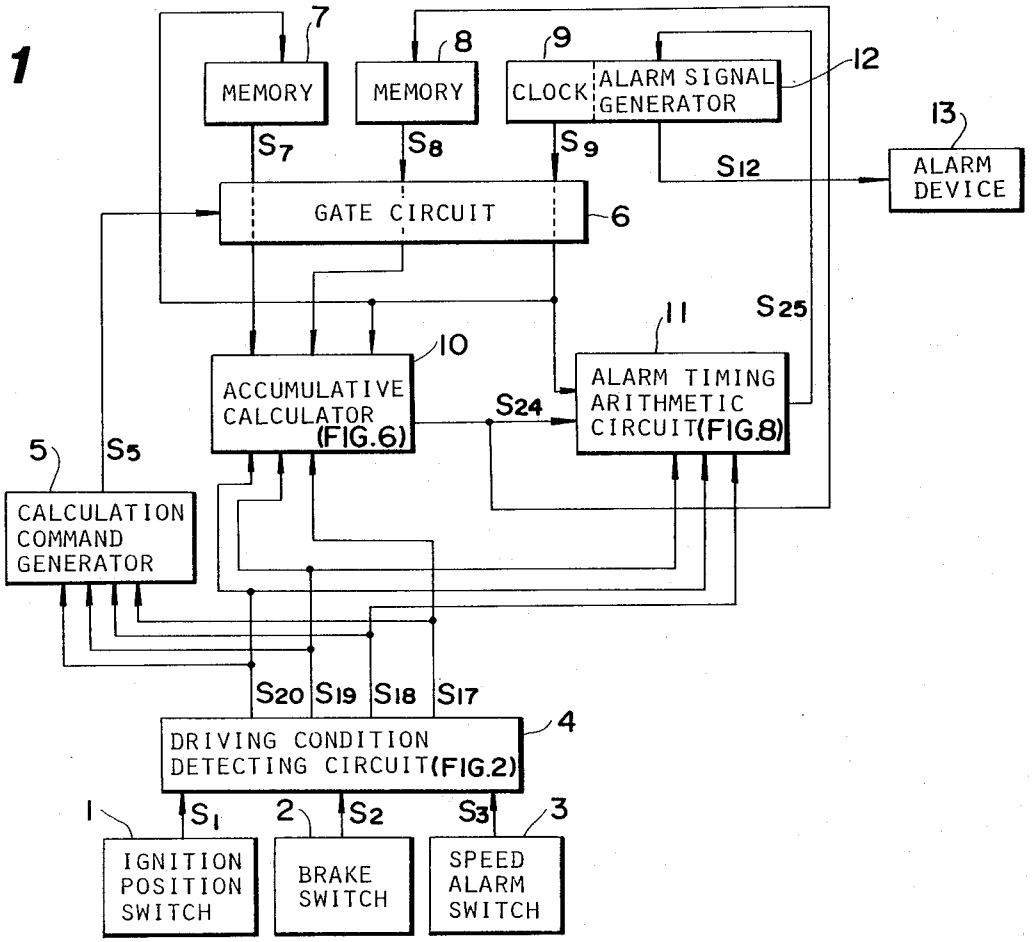
FIG. 1 is a block diagram of a first embodiment of an alarm device according to the present invention.

Referring now to the drawings, particularly to FIG. 1, there is shown the first embodiment of an alarm device according to the present invention.

Figure 2:
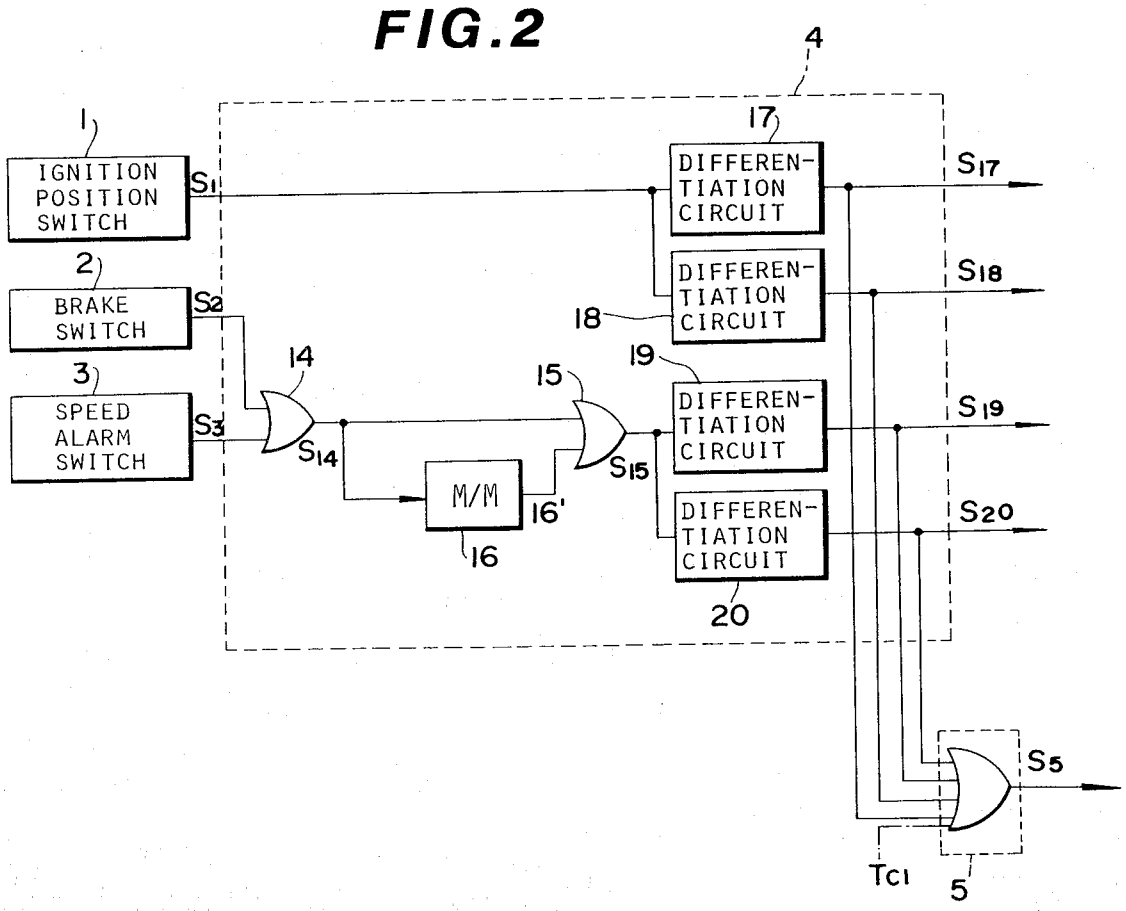
FIG. 2 is a block diagram of a driving condition detecting circuit in the alarm device of FIG. 1.

A driving condition detecting circuit 4 is connected to an ignition position switch 1, a brake switch 2 and a speed alarm switch 3. The ignition position switch 1 is associated with an ignition switch (not shown) so that it is turned on to produce an ignition position signal $S_1$ whenever the ignition switch is turned on. The brake switch 2 is per se well known and produces a braking signal $S_2$ whenever a foot brake (not shown) is applied. The speed alarm switch 3 is also per se well known and adapted to produce a speed alarm signal $S_3$ when a driving speed of the vehicle is higher than a preset speed. The driving condition detecting circuit 4 produces various pulse signals $S_{17}$, $S_{18}$, $S_{19}$ and $S_{20}$ depending on the switch positions of the ignition position switch 1, the brake switch 2 and the speed alarm switch 3, as shown in FIG. 2. The signal $S_{17}$ is produced in response to turning on of the ignition switch. The driving condition detector, in turn, produces the signal $S_{18}$ in response to turning off of the ignition switch. The signal $S_{19}$ is produced in response to either the brake signal $S_2$ or the speed alarm signal $S_3$ and the signal 20 is produced in response to turning off of the brake switch 2 or the speed alarm switch 3 with a predetermined delay time.

Therefore, the signal $S_{17}$ indicates starting of driving of the vehicle, which signal $S_{17}$ is thus referred to hereafter as "drive signal". The signal $S_{18}$, in turn, indicates stopping of driving, which signal $S_{18}$ is referred to hereafter as "rest signal". The signal $S_{19}$ represents a driving condition which causes fatigue for the vehicle driver, which signal $S_{19}$ is referred to hereafter as "fatigue drive signal" and the signal $S_{20}$ indicates ending of the fatigue driving and returning of the driving condition to a normal condition, which signal $S_{20}$ is thus referred to hereafter as "normal driving signal".

The driving condition detecting circuit 4 is, in turn, connected to a calculation command generator 5. The calculation command generator 5 produces a calculation command signal $S_5$ whenever any one of the drive signal $S_{17}$, the resting signal $S_{18}$, the fatigue drive signal $S_{19}$ and the normal drive signal $S_{20}$ is inputted thereto. The calculation command signal $S_5$ is fed to a gate circuit 6 which is connected to memories 7 and 8 and a clock 9. The memory 7 stores a time data representative of a time $T_0$, which time data $T_0$ is updated with an absolute time data value $T_c$ fed from the clock 9 whenever the calculation command signal $S_5$ is inputted to the gate circuit 6. The memory 8 stores an accumulated driving condition data $\Delta t_1$ which is updated per one cycle of calculation. The clock 9 may, for example, be an electric vehicle clock adapted to produce a signal $S_9$ indicative of time data. The gate circuit 6 is responsive to the calculation command $S_5$ to feed the signals $S_7$, $S_8$ and $S_9$ of respective memories 7 and 8 and the clock 9 to an accumulative calculator 10.

On the other hand, the drive signal $S_{17}$, the fatigue drive signal $S_{19}$ and the normal drive signal $S_{20}$ are also fed to the accumulative calculator 10. Additionally, the resting signal $S_{18}$, the fatigue drive signal $S_{19}$ and the normal drive signal $S_{20}$ are also fed to an alarm timing arithmetic circuit 11. The accumulative calculator 10 stores preset coefficients $\alpha$ to be read out in response to respective drive signal $S_{17}$, the fatigue drive signal $S_{19}$ and the normal drive signal $S_{20}$. For example, the constants $\alpha$ are $-6$, 1 and 1.2 respectively corresponding to the rest signal $S_{18}$, the normal drive signal $S_{20}$ and the fatigue drive signal $S_{19}$.

The accumulative calculator performs a calculation according to an equation:

$$(T_c - T_0) \times \alpha + \Delta t_0 = \Delta t_1$$

where $T_c$ is the absolute time data fed from the clock 9 and $T_0$ is the time of the previous measurement which was stored in memory 7. The accumulative calculator 10 feeds the obtained $\Delta t_1$ to the memory 8 to replace the storage thereof with the same. Thus, in the next calculation, the obtained data $\Delta t_1$ serves as $\Delta t_0$. The accumulative calculator 10 produces a condition signal $S_{24}$ indicative of the obtained accumulative condition data $\Delta t_1$ and feeds the condition signal to the alarm timing arithmetic circuit 11. The alarm timing arithmetic circuit 11 also receives the time data $T_c$ from the clock 9 via the gate circuit 6.

The alarm timing arithmetic circuit 11 effects an arithmetic operation according to the following equation:

$$(3 - \Delta t_1)/\beta + T_c = T_a$$

where $\beta$ is a constant preset in the alarm timing arithmetic circuit; and 3 is a preset time in hours for producing an alarm.

The alarm timing arithmetic circuit 11 produces a timing signal $S_{25}$ representative of the calculated alarm time data $T_a$ and feeds the same to an alarm signal generator 12. The alarm signal generator 12 is associated with the clock and is preset to a time to produce the alarm by the alarm time data $T_a$ of the timing signal $S_{25}$. When the time $T_c$ becomes the preset alarm time $T_a$, the alarm signal generator 12 produces an alarm signal $S_{12}$ and feeds the same to an alarm device 13.

It will be appreciated that the alarm device will be any suitable device such as a visible display device for displaying a visible sign or an audible warning system e.g., buzzer, chime warning voice information etc.

Figure 3:
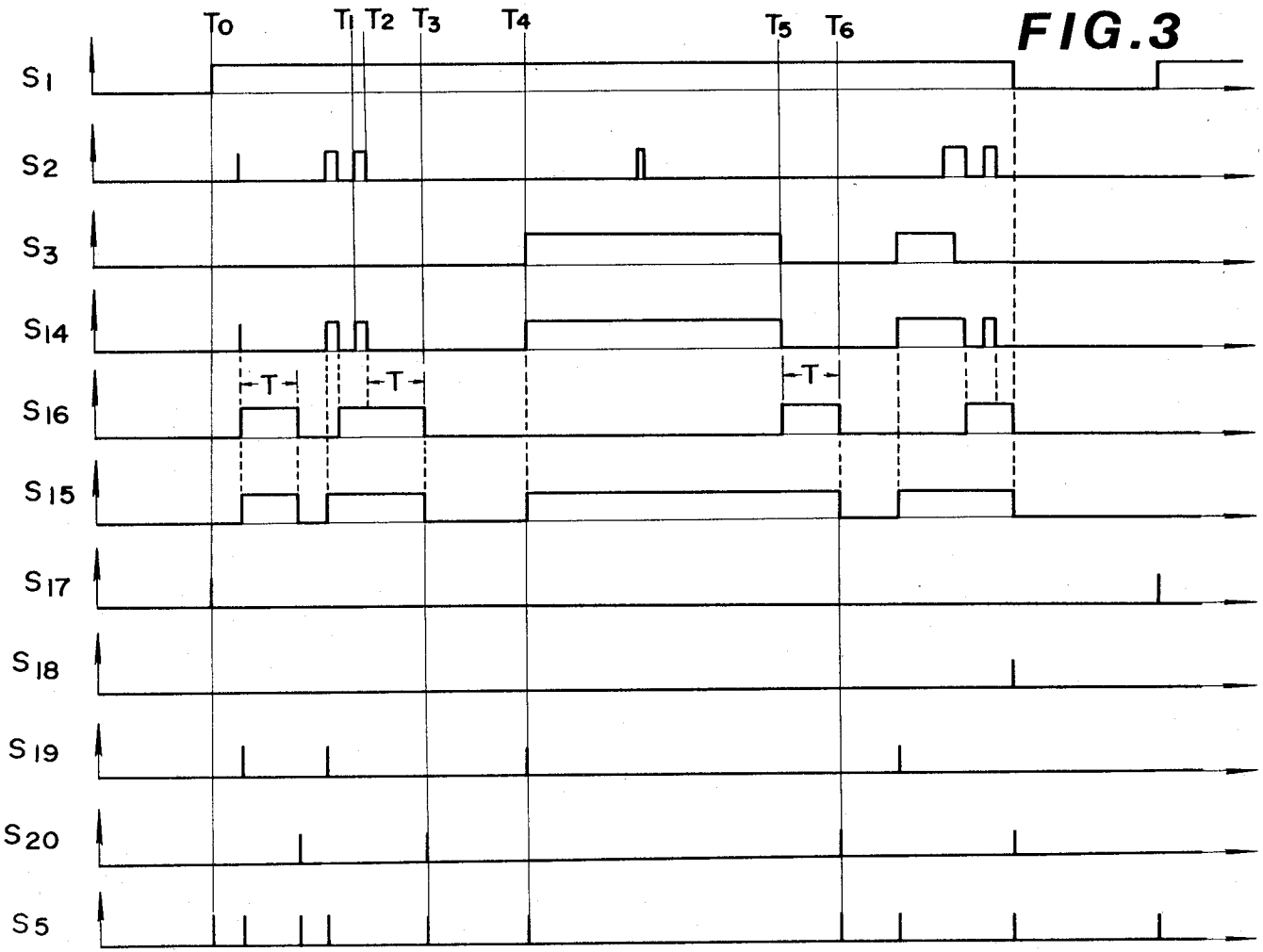
FIG. 3 is a timing chart showing an operation of the drive condition detecting circuit of FIG. 2.

Referring to FIGS. 2 to 9, there is illustrated a detailed construction of the alarm device of FIG. 1 for detecting driver fatigue. FIG. 2 shows a detailed circuit construction of the driving condition detecting circuits 4. The ignition switch 1 is connected to a pair of differentiation circuit 17 and 18. The differentiation circuit 17 is responsive to the leading edge of the ignition position signal $S_1$ to produce an output which serves as the drive signal $S_{17}$. On the other hand, the differentiation circuit 18 is responsive to a trailing edge of the ignition position signal $S_1$ to produce an output which serves as the resting signal $S_{18}$. The brake switch 2 and the speed alarm switch 3 are connected to an OR gate 14. The OR gate 14 is, in turn connected to another OR gate 15. The OR gate 14 is further connected to the OR gate 15 via a retriggerable monostable multivibrator 16. The monostable multivibrator 16 is responsive to the falling edge of OR signal $S_{14}$ of the OR gate 14 to turn on for a given period of time T, as shown in FIG. 3. The differentiation circuit 19 is responsive to the leading edge of the OR signal $S_{15}$ of the OR gate 15 and the differentiation circuit 20 is responsive to the trailing edge of the OR signal $S_{15}$. Since the OR gate 14 is connected to the brake switch 2 and the speed alarm switch 3 and is maintained at a high level as long as either of brake switch 2 or the speed alarm switch 3 is maintained high, the OR signal $S_{15}$ of the OR gate 15 goes high in response to the braking signal $S_2$ or the speed alarm signal $S_3$ and is maintained high for the given period T preset in the monostable multivibrator 16 after the OR gate 14 is turned off. Therefore, the differentiation circuit 20 is turned on in response to the trailing edge of the OR signal $S_{15}$ which is produced after a given delay T from the turning off of OR gate signal $S_{14}$.

The output of the differentiation circuit 19 serves as the fatigue drive signal $S_{19}$ and the output of the differentiation circuit 20 serves as the normal drive signal $S_{20}$.

FIG. 3 shows the function of the driving condition detecting circuit 4 of FIG. 2. As is apparent herefrom, the differentiation circuit outputs $S_{17}$, $S_{18}$, $S_{19}$ and $S_{20}$ are pulse signals having substantially short pulse widths. Assuming the ignition switch is turned on at a time $T_0$, the ignition position switch 1 turns on to produce the ignition position signal $S_1$. In response to the ignition position signal $S_1$, the differentiation circuit 17 produces the drive signal $S_{17}$ at the time $T_0$. In response to the drive signal $S_{17}$, an OR gate of the calculation command generator 5 produces the calculation command $S_5$. Then, at a time $T_1$, the foot brake is applied to turn the brake switch 2 on. In response to the braking signal $S_2$, the differentiation circuit 19 produces the fatigue drive signal $S_{19}$. When the brake is released at the time $T_2$ the differentiation circuit 20 turns on at the time $T_3$ with the given delay T from the time $T_2$ to produce the normal drive signal $S_{20}$. Likewise, in response to the speed alarm signal $S_3$ produced from the time $T_4$, the differentiation circuit 19 becomes operative to produce the fatigue drive signal $S_{19}$ and the differentiation circuit 20 becomes operative at the time period $T_6$ with the delay time T after the period $T_5$ at which the speed alarm switch 3 is turned off.

As appreciated from FIG. 2, the calculation command generator 5 is responsive to any one of the drive signal $S_{17}$, the resting signal $S_{18}$, the fatigue drive signal $S_{19}$ and the normal drive signal $S_{20}$ to produce the calculation command $S_5$. Further, the command signal may be generated periodically at fixed intervals of time, as for example, every 5 seconds, 30 seconds, 60 seconds etc. Such timing signals $T_{c1}$ may be taken from the clock g using a counter (not shown).

Figure 4:
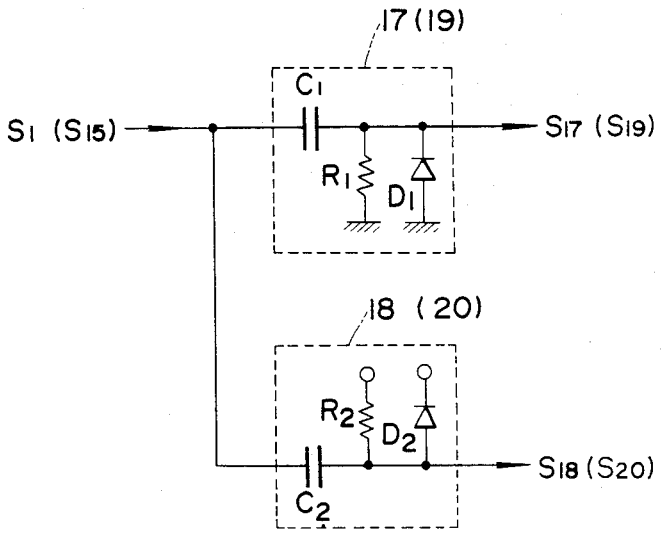
FIG. 4 is a circuit diagram of the differentiation circuit in the drive condition detecting circuit of FIG. 2.
Figure 5:
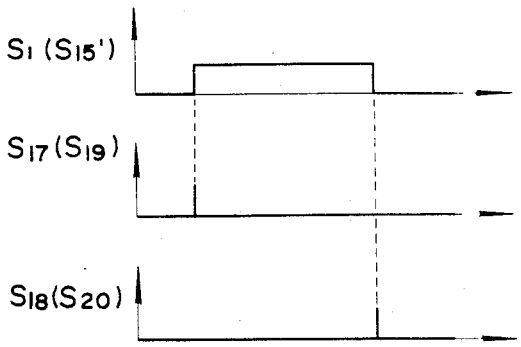
FIG. 5 is a timing chart showing operation of the differentiation circuit of FIG. 4.

As shown in FIG. 4, each of the differentiation circuits 17 and 19 is constituted of a capacitor $C_1$, a resistor $R_1$ and diode $D_1$. The resistor $R_1$ is grounded, and the cathode of the diode $D_1$ is connected to the capacitor $C_1$ and the anode thereof is grounded. With this construction, the differentiation circuits 17 or 19 are responsive to the rising edge of the ignition position signal $S_1$ or the OR signal $S_{15}$, as shown in FIG. 5. On the other hand, each of the differentiation circuits 18 and 20 is constituted by a capacitor $C_2$, a resistor $R_2$ and a diode $D_2$. The resistor $R_2$ is connected to a power source +Vcc and the cathode of the diode $D_2$ is also connected to the power source +Vcc. The anode of the diode $D_2$ is connected to the capacitor $C_2$. By this construction, the differentiation circuit 18 or 20 is responsive to the falling edge of the drive signal $S_1$ or the OR signal $S_{15}$, as shown in FIG. 5.

However the differentiation circuits 17, 18, 19 and 20 are constructed as set forth and as illustrated in FIG. 4, may each be replaced with a circuit including a pair of monostable multivibrators.

Figure 6:
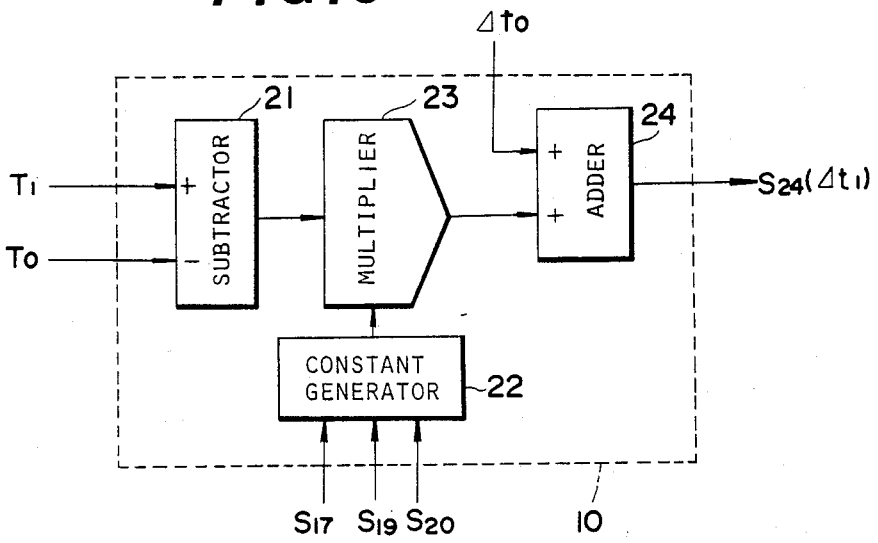
FIG. 6 is a block diagram of an accumulative calculator in the alarm device in FIG. 1.
Figure 7:
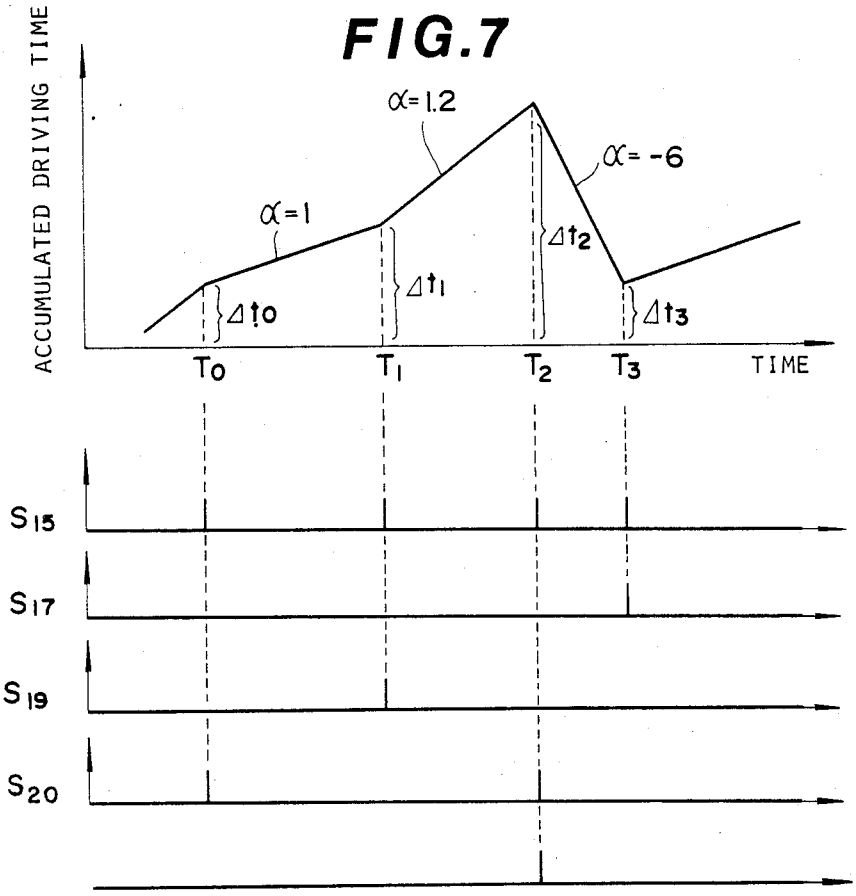
FIG. 7 is a timing chart showing operation of the accumulative calculator of FIG. 6.

FIG. 6 shows the accumulative calculator 10 in detail. To the accumulative calculator 10 are inputted the initial time data $T_0$ stored in the memory 7, the time data $T_1$ fed from the clock 9 and the accumulated driving condition data $\Delta t_0$. In the specific construction, a subtractor 21 is connected to the gate circuit 6 to receive therefrom the initial time data $T_0$ and the time data $T_1$. The subtractor 21 performs a subtraction to obtain the time interval $(T_1-T_0)$. The difference obtained by the subtraction is fed to a multiplier 23. To the multiplier 23, one of three constants, i.e., $=-6$, $=1$ and $=1.2$ are inputted from a constant generator 22. A specific one of the preset constants is taken depending upon which one of the three condition signals, i.e., rest signal $S_{18}$, the normal drive signal $S_{20}$ and the fatigue drive signal $S_{19}$ are inputted thereto. In the multiplier, the obtained time interval $(T_1-T_0)$ is multiplied by the selected constant. The multiplier 23 outputs a signal representative of the product of the multiplying operation to be fed to an adder 24. To the adder 24, the accumulated drive condition data $\Delta t_0$ is inputted through the gate circuit 6. In the adder, the result $(T_1-T_0)\times\alpha$ of the multiplying operation is added to the condition data $\Delta t_0$ read from the memory 8. By this, the foregoing equation $$(T_1-T_0)\times\alpha+\Delta t_0=\Delta t_1$$

is completed to calculate the condition data value. the adder 24 produces the condition signal $S_{24}$ indicative of the result of the foregoing calculation and feeds the condition signal to the alarm timing arithmetic circuit 11 and the memory 8 to update the content therein. FIG. 7 shows experimental values illustrating the variation of the condition data as a function of the foregoing accumulative output of calculator 10. Assuming the condition data accumulated in the memory 8 at the time period $T_0$ is $\Delta t_0$ as illustrated, and the normal drive signals $S_{20}$ are produced at the time periods $T_0$ and $T_2$, the fatigue drive signal $S_{19}$ is produced at the time period $T_1$ and the drive signal is produced at the time period $T_3$, the condition data value $\Delta t_n$ is varied as illustrated. The condition data values $\Delta t_1$, $\Delta t_2$ and $\Delta t_3$ at respective time periods $T_c=T_1$, $T_2$ and $T_3$ can be obtained from the following equations:

$$\Delta t_1=(T_1-T_0)\times 1+\Delta t_0 \qquad T_1$$

$$\Delta t_2=(T_2-T_1)\times 1.2+\Delta t_1 \qquad T_2$$

$$\Delta t_3=(T_3-T_2)\times(-6)+\Delta t_2 \qquad T_3$$

Here, the constants $\alpha$ are selected depending on the driving condition. However, the above specific values have been selected empirically with respect to driving physiology. That is, normally, 30 minutes of rest time is necessary for 3 hours of driving under normal driving condition and for 2 and half hours driving under fatigue driving condition. Therefore, the foregoing specific constant values, i.e., $\alpha=-6$, 1 and 1.2 will be reasonable.

Figure 8:
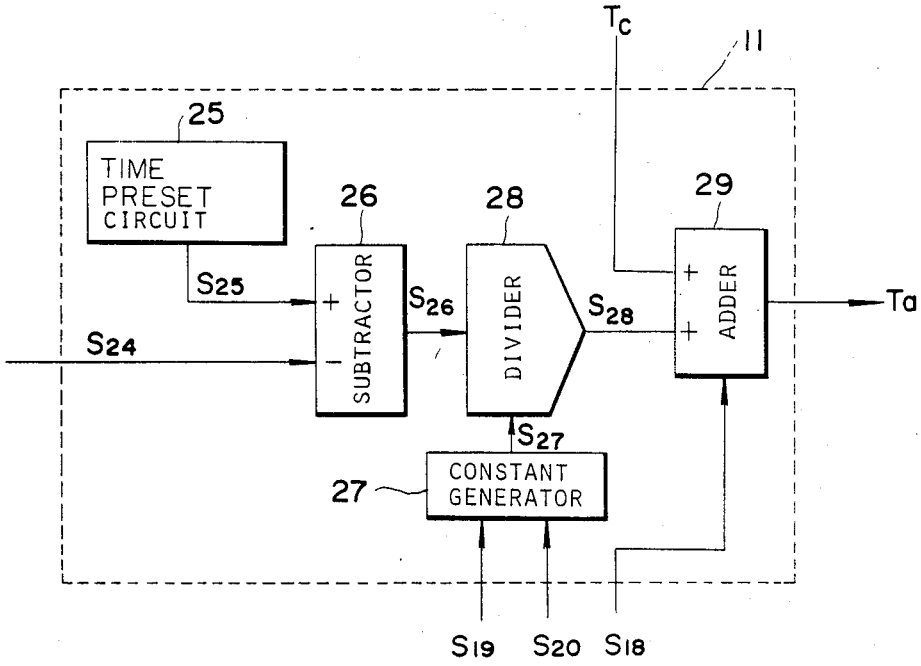
FIG. 8 is a block diagram of an alarm timing arithmetic circuit in the alarm device of FIG. 1.

FIG. 8 shows the alarm timing arithmetic circuit 11 in detail. The alarm timing arithmetic circuit 11 comprises a time preset circuit 25, a subtractor 26, a divider 28, a constant generator 27 and an adder 29. The subtractor 26 is connected to the adder 24 of the accumulative calculator 10 to receive therefrom the condition signal $S_{24}$. To the subtractor 26, the time preset circuit 25 is also connected. The time preset circuit 25 produces a preset time signal $S_{25}$ representative of the driving time interval requiring the driver to a rest. As set forth, it has been considered that it is recommendable to have a rest after every 3 hours driving. Therefore, the preset time in the time preset circuit 25 is 3 hours in the shown embodiment. The subtractor 26 effects a subtracting operation of $(3-\Delta t_1)$. The subtractor 26 then produces a signal $S_{26}$ having a value corresponding to the difference obtained as a result of the subtracting operation. The signal $S_{26}$ is fed to the divider 28. The divider 28 also receives from the constant generator 27 a signal $S_{27}$. The signal value of the signal $S_{27}$ is valuable depending on the condition signal fed from the driving condition detecting circuit 4. As shown in FIG. 8, since the constant generator 27 is connected to the differentiation circuits 19 and 20, the fatigue drive signal $S_{19}$ and the normal drive signal $S_{20}$ is inputted to the constant generator 27. The signal $S_{27}$ of the constant generator 27 is representative of the constant $\beta$ for dividing operation in the divider 28. The constant $\beta$ is presetted in the constant generator 27 and has values 1.2 and 1 respectively corresponding to the fatigue drive signal $S_{19}$ and the normal drive signal $S_{20}$. The divider 28 divides the signal value $(3-\Delta t_1)$ of the signal $S_{26}$ by the constant of the signal $S_{27}$ to produce a signal $S_{28}$ having value $(3-\Delta t_1)/\beta$. The signal $S_{28}$ is fed to an adder 29. To the adder, the clock signal $S_9$ representative of the time $T_c$ is also inputted. The adder 29 adds the time data $T_c$ and the signal value of the signal $S_{28}$ to complete the equation for obtaining the set time $T_a$ for the alarm signal generator 12.

The alarm signal generator 12 sets the set time data $T_a$. The set time data $T_a$ represents a time to produce the alarm. In the alarm signal generator 12, the set time data $T_a$ is compared with the time data $T_c$. When the time data $T_c$ reaches the value of the set time data $T_a$, the alarm signal generator 12 produces an alarm signal $S_{12}$ to activate the alarm device 13. On the other hand, when a rest has been taken, the set time data $T_a$ is reset and in the calculation for obtaining the set time data in response to the next drive signal $S_{17}$, the set time becomes equal to $(3-\Delta t_2)/\beta$.

Figure 9:
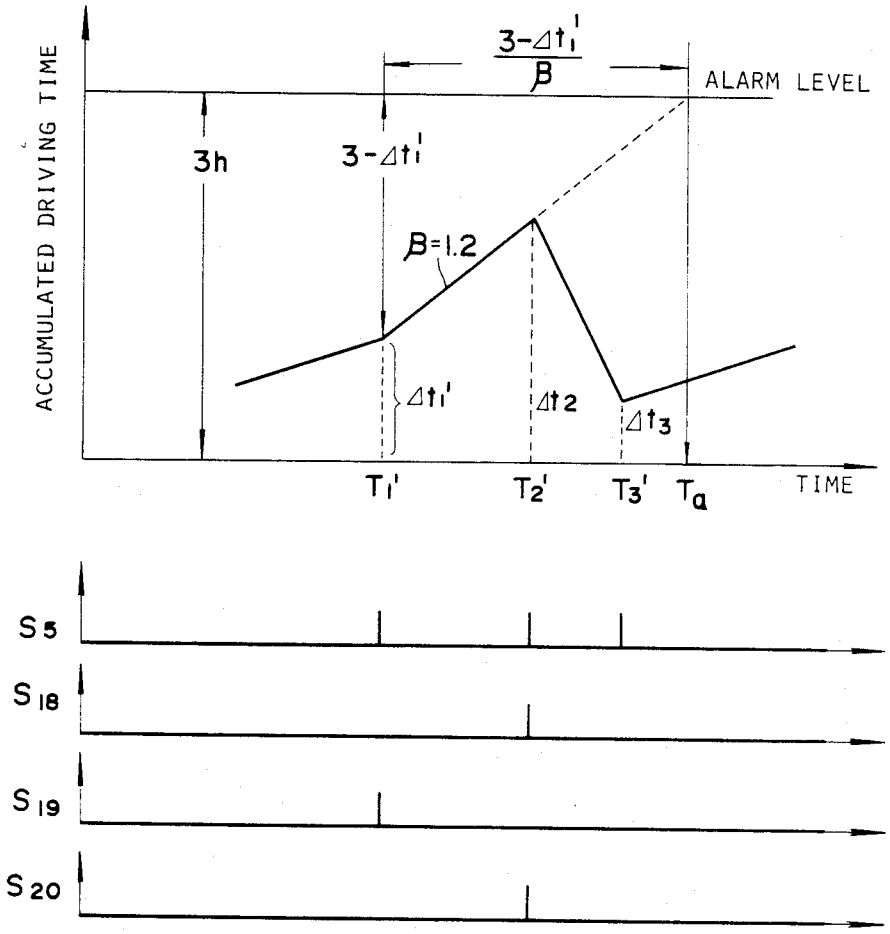
FIG. 9 is a timing chart showing operation of the alarm timing arithmetic circuit of FIG. 8.

FIG. 9 shows the function of the alarm timing arithmetic circuit 11 as set forth in relation to the condition signals. Assuming the fatigue drive signal $S_{19}$ is produced at the time period $T_1'$, the accumulated condition data is $\Delta t_1'$, and the normal drive signal $S_{20}$ is produced at the time period $T_2'$, the set time data $T_a$ obtained from the foregoing arithmetic operation in the alarm timing arithmetic circuit 11 is in a relation with respect to the predetermined alarm level, i.e., 3 hours, as shown in FIG. 9. If the driver take a rest at the time period $T_2'$ and the accumulated condition data $\Delta t_3'$ when the next drive signal $S_{17}$ is inputted, the set time $T_a$ will be obtained from $(3-\Delta t_3')$.

Figure 10:
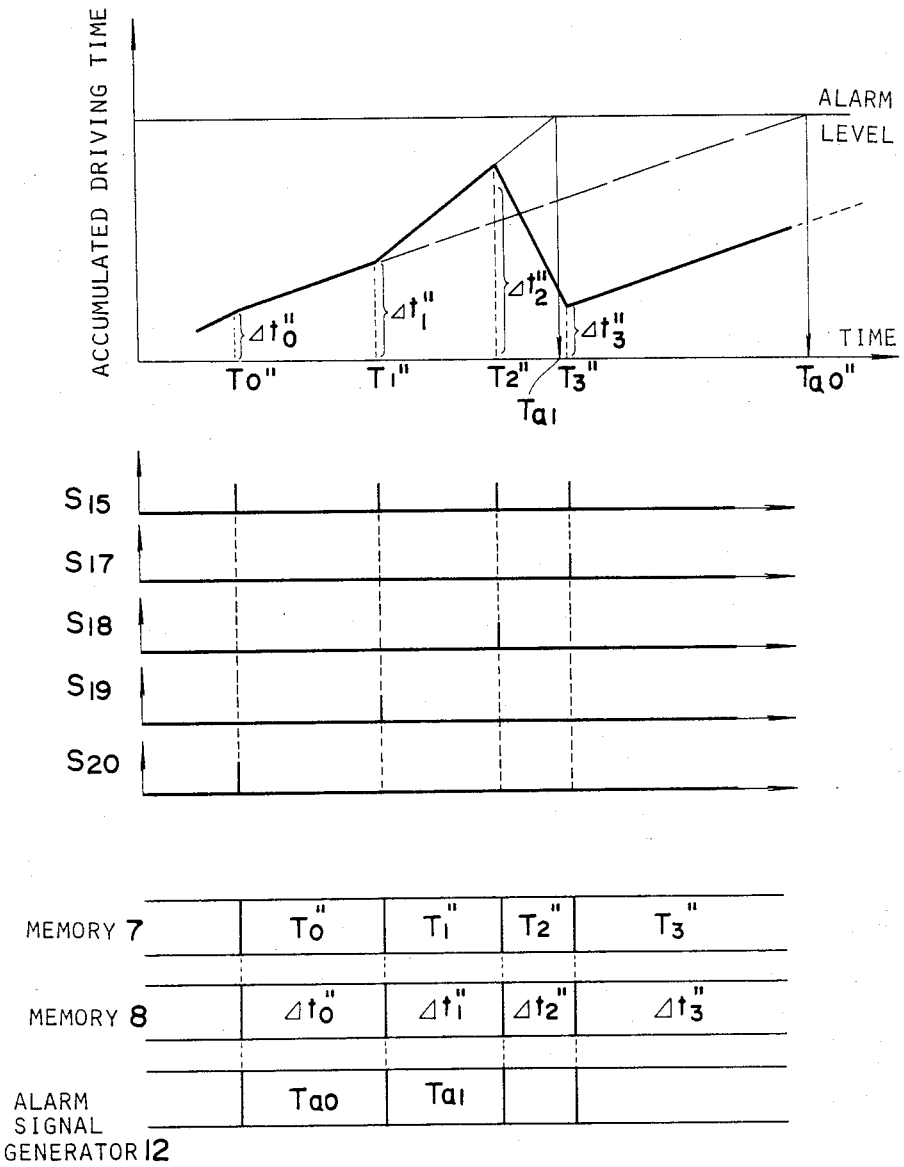
FIG. 10 is a timing chart showing an experimental operation of the alarm device of FIG. 1.

FIG. 10 shows the function of the alarm device of the shown embodiment in relation to the condition signals produced by the drive condition detecting circuit 4. At the time period $T_1''$, the fatigue drive signal $S_{19}$ is produced by application of the brake or vehicle speed exceeding the predetermined speed. In response to the fatigue drive signal $S_{19}$, the calculation command $S_5$ is produced. In response to the calculation command, the accumulative calculator 10 effects calculation to obtain the condition data $\Delta t_0''$. Based on the condition signal $S_{10}$ indicative of the condition data $\Delta t_0''$, the alarm timing arithmetic circuit 11 obtains the set time $T_{a0}$ for the alarm signal generator 12 at the time period $T_1''$. Then, at the time period $T_2''$, the resting signal $S_{18}$ is produced by turning off of the ignition switch. In response to the calculation command $S_5$, the accumulative calculator obtains $\Delta t_2''$ and the alarm timing arithmetic circuit 11 obtains $T_{a1}$.

During these operations, the content of the memories 7 and 8 and the alarm signal generator 12 are varied as illustrated in FIG. 10.

In view of the examples shown in FIGS. 7, 9 and 10 one may write general equations for the n the calculation as follows:

$$\Delta t_n=(T_c-T_{n-1})\times\alpha+\Delta t_{n-1}$$

$$(3-\Delta t_n)/\beta+T_c=T_a$$

Figure 11:
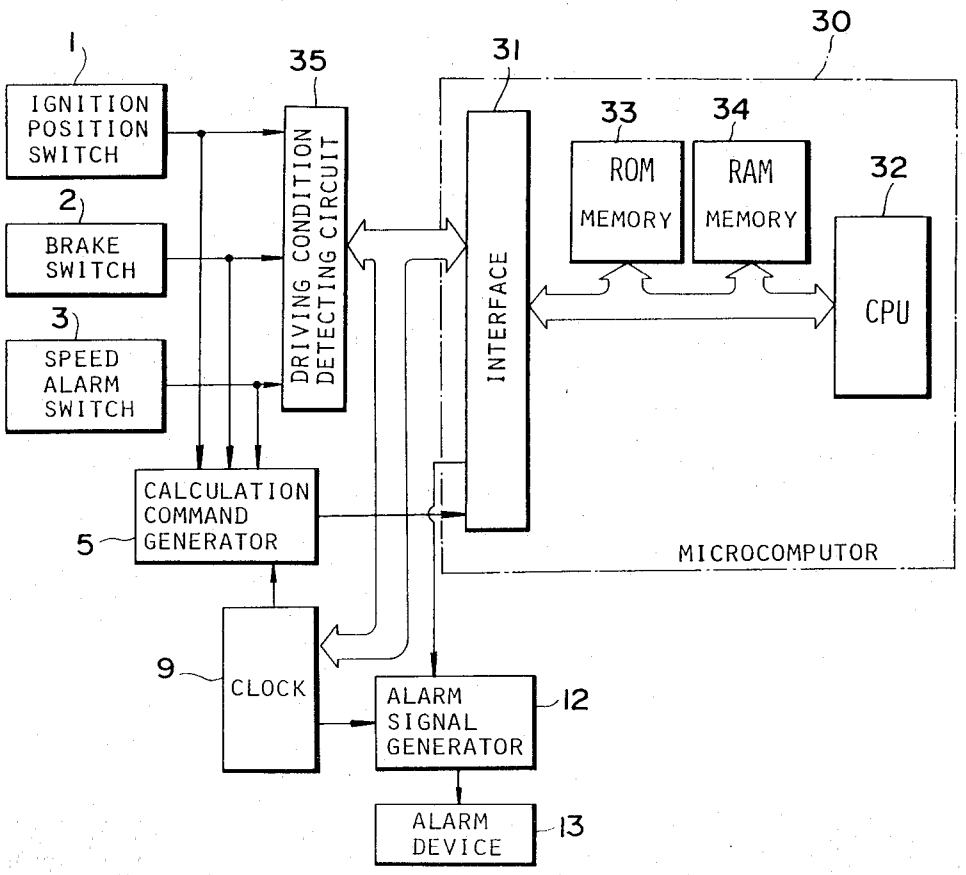
FIG. 11 is a block diagram of a second embodiment of the alarm device according to the present invention.
Figure 12:
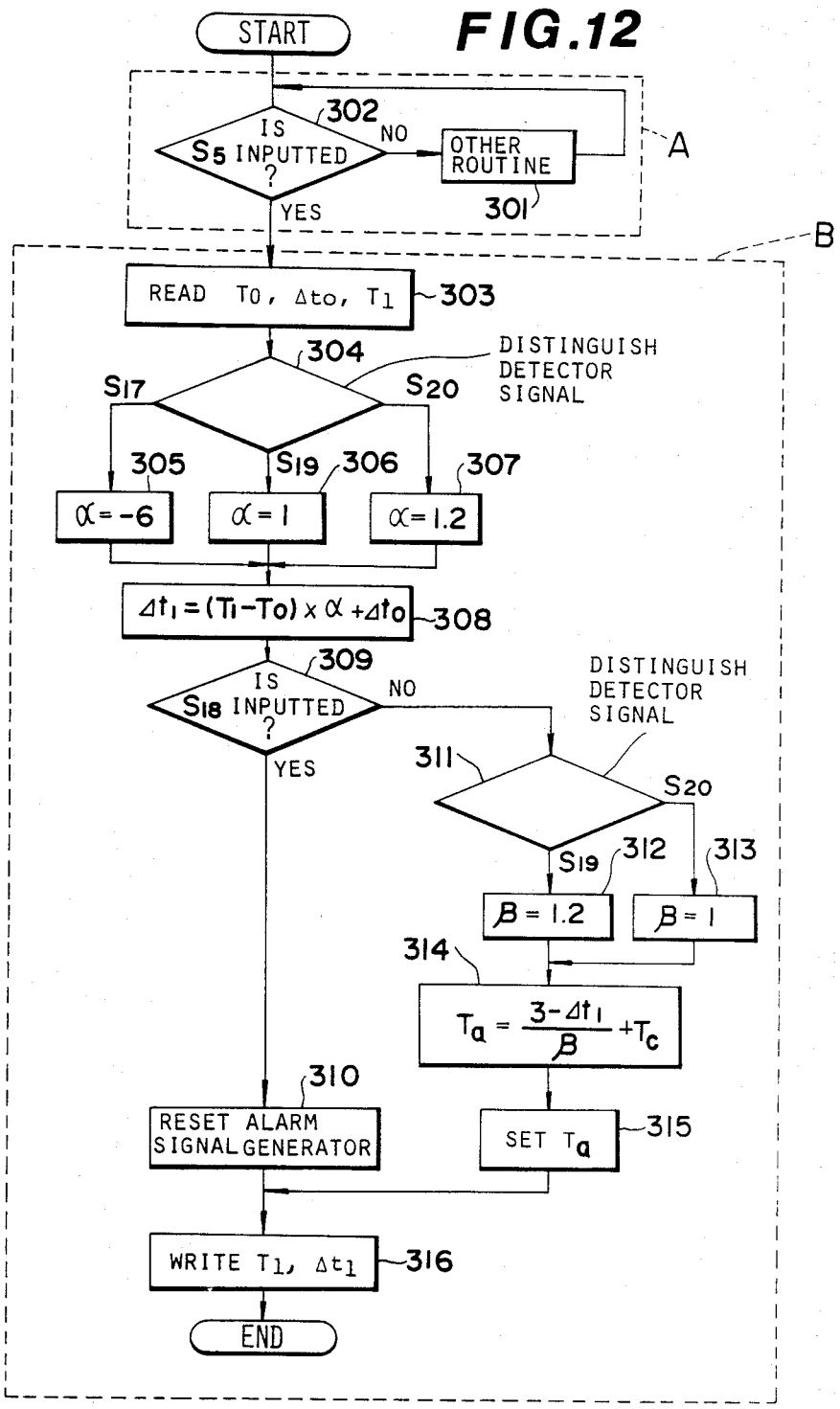
FIG. 12 is a flowchart of an alarm timing calculation program to be processed in the alarm device of FIG. 11.

FIGS. 11 and 12 show the second embodiment of the alarm device according to the present invention. In this embodiment, a microcomputer 30 is applied for precessing the calculations effected by the accumulative calculator and the alarm timing arithmetic circuit of the foregoing first embodiment.

Likewise to the foregoing first embodiment, the ignition position switch 1, the brake switch 2 and the speed alarm switch 3 are connected to the driving condition detecting circuit 35. The driving condition detecting circuit 35 produces the drive signal $S_{17}$, the resting signal $S_{18}$, the fatigue drive signal $S_{19}$ and the normal drive signal $S_{20}$ depending on the signals inputted from the switches 1, 2 and 3. The condition signals, i.e., the drive signal $S_{17}$, the resting signal $S_{18}$, the fatigue drive signal $S_{19}$ and the normal drive signal $S_{20}$, are fed to an interface 31 of the microcomputer 30. At the same time, the condition signals, together with a fixed rate clock signal representative of the desired calculation rate are fed to the calculation command generator 5. The calculation command generator 5 is responsive to the condition signals and fixed rate clock signal to produce the calculation command $S_5$ every time one of the condition signals or clock signals is inputted. The calculation command is fed to the interface to make CPU 32 execute a calculation program to determine the alarm timing. The interface 32 is also connected to an alarm signal generator 12 which functions in the same manner as that of the foregoing first embodiment. The alarm signal generator 12 produces the alarm signal $S_{12}$ when the time reaches the set time, and activates the alarm device 13.

The microcomputer 30 therefore includes RAM 34 and ROM 33. RAM stores data obtained in each cycle of execution of the program, and the ROM stores the program as illustrated in FIG. 12. As apparent from FIG. 11, the interface 31 of the microcomputer 30 also connected to the clock 9 to receive therefrom the signal $S_9$ representative of time T.

The operation of the microcomputer 30 will be described with reference to FIG. 12. The microcomputer 30 executes in normal condition a background job as indicated by the term "other routine" in a block 301. In the background job, there is provided a step 302 for checking the presence of the calculation command $S_5$. When the calculation command $S_5$ is detected at the step 302, the routine of steps 303 to 316 is executed as an interrupt program. At the step 303, accumulated condition data $\Delta t_0$ which is stored in RAM 34 and updated from time to time, a time data $T_0$ of the time when the previous calculation command $S_5$ and the time signal $S_9$ representative of the time data $T_1$ fed from the clock 9 are read out to CPU 32. Thereafter, the condition signal is checked. If the condition signal is the drive signal $S_{17}$, the constant $= -6$ is read out from ROM. If the condition signal is fatigue drive signal $S_{19}$, the constant $= 1$ is read out. If the condition signal is the normal drive signal $S_{20}$, the constant $= 1.2$ is read out. Based on the read out constant, the calculation of the equation of:

$$\Delta t_n = (T_c - T_{n-1}) \times \alpha + \Delta t_{n-1}$$

is effected at a step 308.

After the step 308, the presence of the resting signal $S_{18}$ is checked at a step 309. If the resting signal $S_{18}$ is detected at the step 309, the set time of the alarm signal generator 12 is reset at a step 310. Otherwise, the condition signal is checked to determine whether the signal is either the fatigue driven signal $_{19}$ or the normal drive signal $S_{20}$ at a step 311. If the condition signal inputted is the fatigue drive signal $S_{19}$, the constant $= 1.2$ is read out from ROM at a step 312. On the other hand, if the signal is the normal drive signal $S_{20}$, the constant $= 1$ is read out from ROM at a step 313. Based on the read out constant and the condition data $\Delta t_n$ read from RAM 34, the calculation according to the equation:

$$T_a = (3 - \Delta t_n)/\beta + T_c$$

is effected at a step 314. The result $T_A$ of the calculation at the step 314 represents the set time data to be set in the alarm signal generator 12. The set time data $T_a$ is fed to the alarm signal generator 12 via the interface 31 at the step 315.

Thereafter, at a step 316, the time data $T_1$, and the condition data $\Delta t_n$ are written in RAM. The time data $T_c$ and the condition data $\Delta t_n$ written in RAM 34 respectively serve as the time data $T_0$ and the condition data $\Delta t_{n-1}$ in the next cycle of the execution of the foregoing program. Then the interrupt routine ends to return to the background job.

Thus, the invention fulfills all of the object and advantages sought therefor.

While the invention has been described in detail with reference to the drawings of the preferred embodiments, the invention should be understood as including all of the possible modifications embodied without departing from the principle of the invention.

What is claimed is:

1. A method for alerting a driver of an automotive vehicle, comprising the steps of:

detecting an elapsed period of time beginning at a predetermined point of time, detecting a vehicle driving condition and calculating a driving fatigue value based on said detected driving condition and said elapsed period of time, calculating an alarm time based on said driving fatigue value; and producing an alarm when said elapsed time reaches said alarm time.

2. A method for alerting a fatigued driver of an automotive vehicle, comprising the steps of:

(a) measuring driving time corresponding to time during which the driver drives the vehicle;

(b) detecting a vehicle driving condition;

(c) arithmetically calculating a fatigue value of the driver based on said measured driving time and said vehicle driving condition, and accumulating the calculated fatigue value;

(d) calculating an alarm time based on the accumulated fatigue value;

(e) comparing said calculated alarm time with the measured driving time, (f) repeating steps (a)-(e) upon detection of a change in a vehicle driving condition, and (g) producing said alarm when the measured time becomes equal to a greater than said alarm time.

3. A method as set forth in claim 1 or 2, wherein said detecting step includes detecting a vehicle ignition switch position.

4. A method as set forth in claim 3, wherein said detecting step includes detecting application and release of a brake in the vehicle.

5. A method as set forth in claim 3, wherein said detecting step includes detecting a vehicle speed.

6. A method as set forth in claim 4, wherein said detecting step includes detecting a vehicle speed in relation to a preset speed.

7. A method as set forth in claim 2, wherein said calculating step includes the steps of presetting constants representative of the fatigue of the driver to be accumulated for a unit time, which constants respectively correspond to fatigue to be accumulated under different driving conditions of the vehicle, and multiplying the measured time during which a specific driving condition is maintained by a selected one of the constants corresponding to the specific driving condition.

8. A device for generating an alarm for a fatigued driver of an automotive vehicle, comprising:

first means for repeatedly measuring a driving time;

second means for setting a time threshold for producing an alarm when the measured driving time equals or exceeds said time threshold, said second means comparing said measured driving time with said set time threshold to produce the alarm;

third means for detecting a variation of driving conditions of the vehicle and producing a signal indicative of detection of variation in a driving condition;

fourth means for calculating fatigue data based on said driving condition indicative signal and on the driving time measured by said first means to obtain fatigue data for the driver, said fourth means including a memory for storing the obtained fatigue data which is updated whenever said driving condition changes; and fifth means for correcting said set time threshold of said second means based on the fatigue data stored in said fourth means.

9. The device as set forth in claim 8, wherein said third means comprises a detector for detecting an ignition switch position and producing a first detector signal when the ignition switch is turned on, said fourth means responsive to said first detector signal.

10. The device as set forth in claim 8 or 9, wherein said third means includes a detector for detecting application of a brake to produce a second signal and/or a detector for detecting a vehicle speed to produce a third signal when the detected vehicle speed is higher than a predetermined speed, said fourth means responsive to said second and/or third signal.

11. A device as set forth in claim 10, wherein said third means includes a signal generator for producing a command for activating said fourth and fifth means whenever the vehicle driving condition is varied.

12. A device as set forth in claim 11, wherein said fourth means comprises another memory for storing various constants respectively corresponding to respective driving conditions detected by said third means, and an arithmetic means for processing time data obtained from said first means and said fatigue data for determining an accumulation of fatigue of the driver.

13. A device as set forth in claim 12, wherein said fourth means is connected to said second means for cooperating therewith in varying the set time.

14. A method for determining fatigue of an automotive vehicle driver and for alarming the driver, comprising the steps of:

detecting time elapsed while driving the vehicle to produce an elapsed time indicative signal;

detecting vehicle driving conditions including a first condition in which the driver is substantially resting and a second condition in which the driver's fatigue exceeds fatigue under a normal driving condition, and producing a driving condition indicative signal having a value representative of the detected driving condition;

deriving a value indicative of accumulated fatigue of the driver based on values of the elapsed time indicative signal and of the driving condition indicative signal;

varying a predetermined time threshold which corresponds to a standard fatigue level of the driver in a continuous driving operation under normal driving conditions to exceed an allowable range, on the basis of the derived accumulated fatigue value and on an instantaneous value of the driving condition indicative signal, and producing a time threshold indicative signal having a value indicative of the modified time threshold; and comparing the value of said elapsed time indicative signal with the value of said time threshold indicative signal for generating an alarm when the value of the elapsed time indicative signal exceeds the value of the time threshold indicative signal.

15. The method as set forth in claim 14, which further comprises the steps of detecting vehicle speed to produce a vehicle speed indicative signal having a value representative of the detected vehicle speed, and wherein said second driving condition is detected when the value of said vehicle speed indicative signal exceeds a given speed threshold.

16. The method as set forth in claim 14, wherein said step of detecting said second driving condition comprises the step of detecting application of a vehicle brake.

17. The method as set forth in any one of claims 14, 15 or 16, wherein said step of detecting said first driving condition further includes steps of detecting an engine stopped condition and measuring a period of time while the engine is maintained in the stopped condition to produce a resting time indicative signal having a value indicative of the measured period of time.

18. The method as set forth in claim 17, in which the step of deriving fatigue value includes the step of reducing the fatigue value by a value proportional to the value of said resting time indicative signal.

19. The method as set forth in claim 18, which further comprises the step of detecting variation of the value of said driving condition indicative signal to produce a driving condition change indicative signal, and wherein said step of varying the time threshold is performed in response to said driving condition change indicative signal.

20. A system for detecting fatigue of an automotive vehicle driver and for alarming the driver when detected fatigue exceeds a predetermined allowable level, comprising:

a timer means for sequentially measuring elapsed time to produce a timer signal having a value indicative of the measured elapsed time;

a detector means for detecting vehicle driving conditions including a first condition in which the driver is substantially resting and a second condition in which the driver's fatigue accumulates at a greater rate than that accumulated under normal driving condition, said detector means producing a detector signal having a value variable according to the detected vehicle driving condition;

arithmetic means for deriving a fatigue value representative of accumulated driver fatigue on the basis of the values of said timer signal and said detector means signal, said arithmetic means producing a fatigue value indicative signal having a value indicative of the derived fatigue value;

a reference signal generator means producing a reference signal having a value representative of a time threshold corresponding to said predetermined allowable fatigue level, said reference signal generator means being responsive to said detector means signal and to said fatigue value indicative signal for modifying the value of said reference signal;

a comparator means for comparing the value of said timer signal with the value of said reference signal as modified to produce a comparator signal when the value of said timer signal is greater than the value of said reference signal as modified; and an alarm generator means responsive to said comparator signal to generate the alarm.

21. The system as set forth in claim 20, wherein said detector means comprises a vehicle speed detector means for detecting vehicle speed and means for producing the detector signal indicative of said second driving condition when the detected vehicle speed is higher than a predetermined speed threshold.

22. The system as set forth in claim 20, wherein said detector means comprises a brake position detector means for detecting application of an automotive brake for producing the detector signal indicative of said second driving condition when application of the brake is detected.

23. The system as set forth in claim 20, wherein said detector means comprises an ignition switch and means for detecting turning off of the ignition switch to produce said detector signal indicative of said first driving condition as long as the ignition switch remains in the turned off position.

24. The system as set forth in claims 21, 22 or 23 which further comprises second means for detecting variation of the value of said detector signal, said second detecting means associated with said reference signal generator means to activate the latter whenever a change is detected in the value of said detector signal.

25. The system as set forth in claim 24, wherein said arithmetic means is operable for integrating the derived fatigue value while the driving condition is other than said first condition and for subtracting a derived value based on the period of time in which the value of the detector signal remains at a value indicative of said first driving condition.

26. The system as set forth in claim 25, wherein said detector signal values respectively representative of respective different vehicle driving conditions correspond to coefficients for deriving said fatigue value.

* * * * *